US009683182B2

(12) United States Patent
Smegal et al.

(10) Patent No.: US 9,683,182 B2
(45) Date of Patent: Jun. 20, 2017

(54) TWO-STAGE DIESEL AROMATICS SATURATION PROCESS UTILIZING INTERMEDIATE STRIPPING AND BASE METAL CATALYST

(71) Applicant: SHELL OIL COMPANY, Houston, TX (US)

(72) Inventors: John Anthony Smegal, Houston, TX (US); Aristides Macris, The Woodlands, TX (US); Yvonne Johanna Lucas, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 140 days.

(21) Appl. No.: 14/281,485

(22) Filed: May 19, 2014

(65) Prior Publication Data

US 2014/0339132 A1 Nov. 20, 2014

Related U.S. Application Data

(60) Provisional application No. 61/825,329, filed on May 20, 2013.

(51) Int. Cl.

| | |
|---|---|
| ***C10G 65/08*** | (2006.01) |
| ***C10G 67/02*** | (2006.01) |
| ***C10G 45/50*** | (2006.01) |
| *C10G 65/00* | (2006.01) |
| *C10G 65/02* | (2006.01) |
| *C10G 65/04* | (2006.01) |

(52) U.S. Cl.
CPC ..... *C10G 65/08* (2013.01); *C10G 45/50* (2013.01); *C10G 67/02* (2013.01)

(58) Field of Classification Search
CPC ..... C10G 65/00; C10G 65/02; C10G 65/04; C10G 65/08
See application file for complete search history.

(56) References Cited

U.S. PATENT DOCUMENTS

| | | | |
|---|---|---|---|
| 3,236,764 | A | 2/1966 | Herder et al. |
| 5,110,444 | A | 5/1992 | Haun et al. |
| 5,114,562 | A | 5/1992 | Haun et al. |
| 6,218,333 | B1 | 4/2001 | Gabrielov et al. |
| 6,281,158 | B1 | 8/2001 | Gabrielov et al. |
| 6,290,841 | B1 | 9/2001 | Gabrielov et al. |

(Continued)

FOREIGN PATENT DOCUMENTS

| | | |
|---|---|---|
| EP | 321713 | 6/1989 |
| EP | 1319701 | 6/2003 |

(Continued)

*Primary Examiner* — Brian McCaig
(74) *Attorney, Agent, or Firm* — Charles W. Stewart

(57) ABSTRACT

A process for making high cetane diesel. The process includes contacting a distillate feedstock in a hydrodenitrogenation and polyaromatics saturation zone and passing the resulting treated effluent to a high pressure stripping zone. The stripped liquid fraction from the high pressure stripping zone is contacted with a base metal catalyst under monoaromatics saturation conditions to yield a reactor product. The reactor product undergoes a separation to provide a hydrogen portion and a dearomatized distillate portion with the hydrogen portion being recycled and introduced into the high pressure stripping zone.

4 Claims, 1 Drawing Sheet

(56) References Cited

U.S. PATENT DOCUMENTS

| | | | | |
|---|---|---|---|---|
| 6,787,025 | B2 * | 9/2004 | Mukherjee | C10G 65/12 208/105 |
| 7,381,321 | B2 | 6/2008 | Benazzi et al. | |
| 7,790,020 | B2 | 9/2010 | Kokayeff et al. | |
| 8,262,905 | B2 | 9/2012 | Gabrielov et al. | |
| 2005/0167334 | A1 | 8/2005 | Galeazzi | |
| 2009/0095656 | A1 | 4/2009 | Kokayeff et al. | |

FOREIGN PATENT DOCUMENTS

| | | |
|---|---|---|
| JP | 2005028248 | 2/2005 |
| JP | 2008513337 | 5/2008 |
| JP | 2010042370 | 2/2010 |
| WO | 2009085696 | 7/2009 |

* cited by examiner

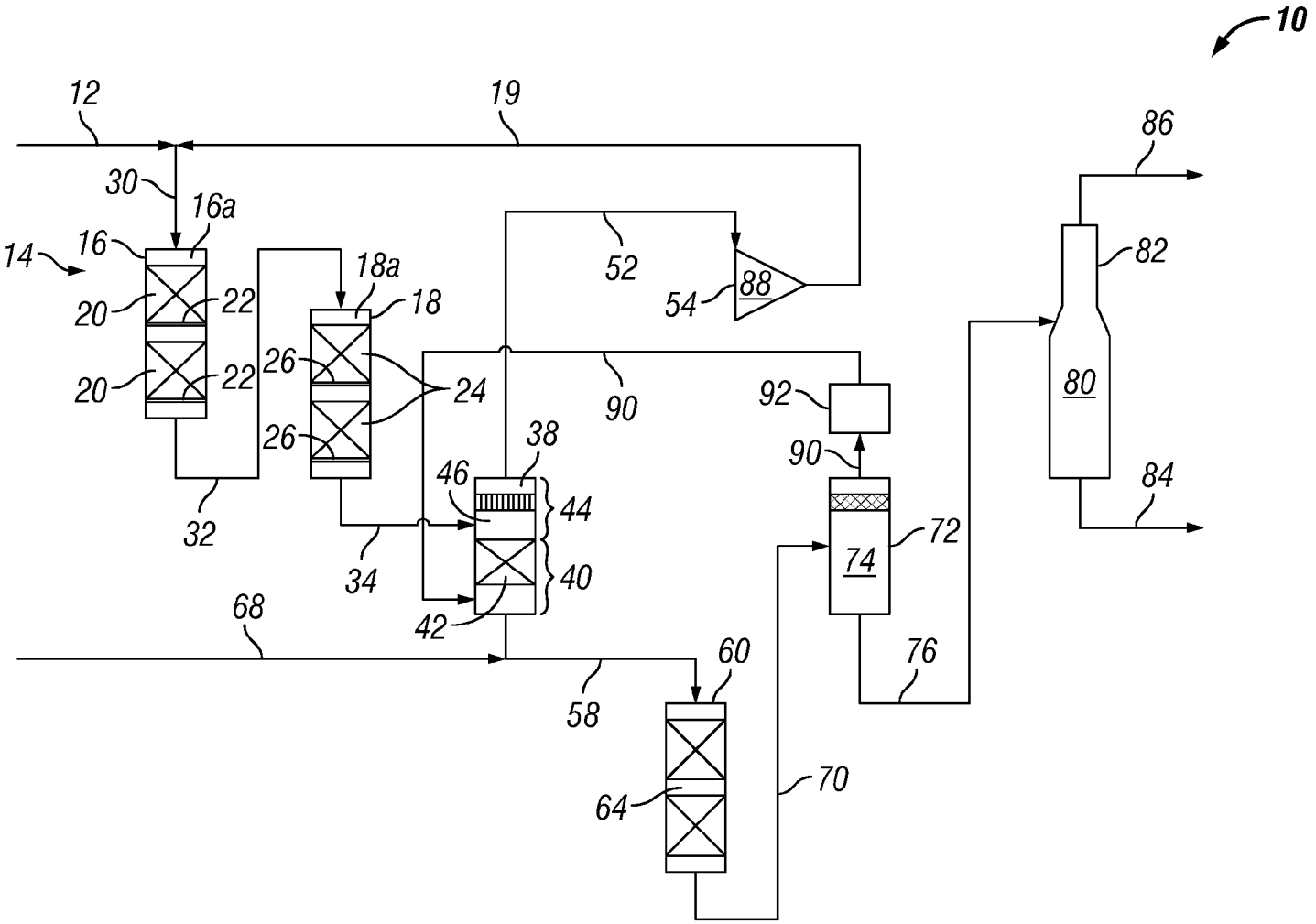
10
86
82
80
84
72
76
74
90
92
70
88
54
60
64
52
90
58
44
40
38
46
42
19
24
18
18a
34
26
26
68
22
22
16a
32
30
16
20
20
12
14

TWO-STAGE DIESEL AROMATICS SATURATION PROCESS UTILIZING INTERMEDIATE STRIPPING AND BASE METAL CATALYST

PRIORITY CLAIM

The present non-provisional application claims the benefit of U.S. Provisional Application No. 61/825,329, filed May 20, 2013.

FIELD OF THE INVENTION

The invention relates to a process for improving the properties of a distillate feedstock having a nitrogen concentration, a polyaromatics concentration and a cetane index.

BACKGROUND OF THE INVENTION

Distillate feedstocks that have significant concentrations of organic nitrogen and polyaromatic compounds are more difficult to upgrade by the removal of the nitrogen and polyaromatic compounds in order to provide a saleable product than it is to upgrade distillate feedstocks of which the primary concern is the removal of organic sulfur and monoaromatic compounds.

In recent years, distillate product quality specifications have become more stringent, which have made it more difficult to meet the quality specifications with existing processing schemes. Due to these new, more stringent product specifications, existing processes are required to be modified so as to be able to process the distillate feedstocks to yield products that meet the specifications. Also, it is desirable to develop new processes that can provide for the manufacture of distillate products which meet the more stringent standards. For diesel fuel products, the quality correlates with the Cetane Index. Generally, it is desired to have a high Cetane Index that is preferably greater than 40. The value of the Cetane Index for diesel fuel tends to negatively correlate with the aromatics concentration level with higher concentrations of aromatics tending to lower the Cetane Index and lower concentrations tending to increase the Cetane Index.

In the processing of diesel feedstocks, it typically is more difficult to convert or remove concentrations of polyaromatics than it is to convert or remove comparable concentrations of monoaromatics, and it is also more difficult to convert or remove concentrations of organic nitrogen than it is to convert or remove comparable concentration levels of organic sulfur.

One process for producing a low sulfur diesel product with a high cetane number is disclosed in U.S. Pat. No. 7,790,020. In this process, a diesel feed is first subjected to a hydrodesulfurization step, operated at low-pressure conditions, with a minimal saturation of aromatics. The effluent from the desulfurization zone is then introduced into a separation zone whereby it is separated into a vapor stream and a liquid hydrocarbon stream. The separator, however, does not function as stripper or utilize stripping gas in the separation. The liquid hydrocarbon stream from the separator is admixed with hydrogen, and the admixture is passed to a substantially liquid-phase continuous reaction zone that is operated at high-pressure conditions significantly above those of the hydrodesulfurization step to provide for the saturation of aromatics and to yield an effluent having an improved cetane number of at least 40. There is no disclosure by the '020 patent of a second stage separator for the vapor/liquid separation of the second reactor stage effluent of its process, and, thus, there is shown no second stage hydrogen recycle. Due to the operation of the hydrotreating zone at a low pressure, a small, low-pressure recycle compressor, instead of a high-pressure recycle compressor, is used to recycle hydrogen to the first stage hydrodesulfurization zone.

There is no mention in the '020 patent of hydrodenitrogenation or partial saturation of polyaromatics to monoaromatics as taking place in the first step of the process. Due to the low-pressure operation of the first step, it would be expected that no significant hydrodenitrogenation of a feedstock having a high organic nitrogen concentration would occur. It is further noted that there is no mention of the use of multiple catalyst beds contained within a single reactor vessel or the use of interbed quenching.

Another process disclosed in the art for the hydrotreating of middle distillate feeds to produce a low-sulfur and low-aromatic diesel product is described in U.S. Pat. No. 5,110,444. This process employs three reaction zones in series with the first two reaction zones intended to provide a high degree of desulfurization and the third reaction zone intended to provide a high degree of aromatics saturation. The first reaction zone employs a desulfurization catalyst that comprises either nickel and molybdenum or cobalt and molybdenum on a support.

The hydrocarbons leaving the first and second reaction zones of the process are subjected to countercurrent stripping with hydrogen to remove hydrogen sulfide prior to passage into the next reaction zone. The first stage stripper overhead is not recycled to the first stage reactor, but, instead, it is combined with the stripped liquid from the second stage stripper prior to feeding the mixture to the third reactor stage. The overhead from the second stage stripper is not recycled or used as a stripping fluid in the first stage stripper. Rather, it is recycled with the feed to the first reactor stage.

The second reaction zone of the process of U.S. Pat. No. 5,110,444 provides for a mild desulfurization, and it utilizes a noble metal catalyst. The second reaction zone is operated at desulfurization conditions similar to those of the first reaction zone but at a higher pressure and lower temperature. The third reaction zone is operated as a hydrogenation zone that contains a catalyst comprising a noble metal on an inorganic support. The reaction conditions of the third reaction zone are maintained to provide for the saturation of a substantial portion of the aromatic hydrocarbons present in the entering materials, with a low hydrogen sulfide concentration. These reaction conditions include the highest pressure and lowest temperature of the three reaction zones of the process.

U.S. Pat. No. 5,114,562 discloses a process for hydrotreating middle distillate feeds to produce a low-sulfur and low-aromatic product. The process of U.S. Pat. No. 5,114,562 utilizes just two reaction zones operated in series instead of the three reaction zones that are operated in series as in the process of U.S. Pat. No. 5,110,444. The first reaction zone is intended to provide a high degree of desulfurization, and the second reaction zone is intended to provide a high degree of aromatics saturation. The effluent from the first reaction zone is purged of hydrogen sulfide by countercurrent stripping with hydrogen prior to its passage to the second reaction zone. The stripping hydrogen is indicated to be from a source external to the process and serves as hydrogen make-up gas. The hydrogen separated by the stripper, after treatment to remove hydrogen sulfide, and a portion of the second stage separator hydrogen-rich gas are combined with the liquid phase from the stripper and then passed as a feed to second reaction zone. The first reaction zone uses a desulfurization catalyst comprising nickel and molybdenum or cobalt and molybdenum on a support, and the second reaction zone uses a noble metal hydrogenation catalyst that comprises platinum or palladium on alumina.

Although there is a wide variety of process flow schemes, operating conditions, and catalysts that are used in the processing of middle distillate feedstocks to make diesel products, there is always a desire to provide new and more economical or better methods of manufacturing diesel products. In many cases, even minor variations in process flows or operating conditions or in the catalyst used can have significant effects on process performance and the quality of the end-products.

SUMMARY OF THE INVENTION

Accordingly, a process is provided for improving the properties of a distillate feedstock having a nitrogen concentration, a polyaromatics concentration and a Cetane Index. This process includes the contacting of the distillate feedstock with a first catalyst contained within a first reaction zone that provides for the hydrodenitrogenation of organic nitrogen compounds and for the saturation of polyaromatic compounds, wherein the first reaction zone is operated under suitable hydrodenitrogenation and polyaromatics saturation conditions. A treated effluent, having a reduced nitrogen concentration relative to the nitrogen concentration and a reduced polyaromatics concentration relative to the polyaromatics concentration, is yielded from the first reaction zone. The treated effluent is then passed to a high pressure interstage stripper, comprising a stripper vessel which defines a lower section, including a stripping zone, and an upper section, including a phase separation zone, and is introduced into the upper section of the stripper vessel. A stripped liquid fraction is yielded from the lower section of the high pressure interstage stripper, and a gaseous fraction is yielded from the upper section of the high pressure interstage stripper. The stripped liquid fraction is contacted with a second catalyst contained within a second reaction zone for the saturation of monoaromatics, wherein the second reaction zone is operated under suitable monoaromatics saturation conditions. A reactor product is yielded from the second reaction zone, which includes the second catalyst that comprises a base metal catalyst comprising either a nickel component or cobalt component and either a molybdenum component or a tungsten component supported on an inorganic oxide support. The reactor product comprises a distillate portion having an enhanced Cetane Index relative to the Cetane Index of the distillate feedstock. The reactor product is then passed to a second separator for separating the reactor product into a hydrogen portion and a dearomatized distillate portion. The first hydrogen portion from the second separator is introduced into the lower section of the stripper vessel.

BRIEF DESCRIPTION OF THE DRAWING

The FIGURE is a simplified process flow diagram representing an embodiment of the inventive process for improving the properties of a distillate feedstock to yield a high quality diesel product.

DETAILED DESCRIPTION

As mentioned above, the inventive process deals with the processing of middle distillate feedstocks in order to make low-sulfur diesel that has a low aromatics content. The low aromatics content provides for a diesel product that has a high value for its cetane index. This process is especially useful in the processing of middle distillate feedstocks having high concentrations of organic nitrogen compounds that need to be removed as well as high concentrations of organic sulfur compounds to provide a low-sulfur, and, preferably, an ultra-low sulfur, diesel product. It also is a feature of the process to provide for the processing of such middle distillate feedstocks that also have a concentration of polynuclear aromatic compounds that need to be removed in order to provide a diesel product meeting required quality characteristics as represented by its characteristic Cetane Index.

The prior art processes typically are not focused on the removal of organic nitrogen compounds from a distillate feedstock, but, rather, the focus is on desulfurization. These processes further do not address both denitrogenation and polynuclear aromatics saturation of distillate feedstocks having atypically high concentrations of both organic nitrogen and polynuclear aromatic compounds as well as concentrations of organic sulfur. The inventive process, however, provides for the processing of such difficult-to-treat feedstocks in order to yield a low-sulfur, preferably, an ultra-low sulfur, diesel product that has especially low concentrations of both polynuclear and monoaromatic compounds.

Another feature of the inventive process is that it provides for the processing of the difficult-to-treat feedstocks without the use of highly expensive noble metal catalysts. The process provides for the use of certain low-cost base metal catalysts in the saturation of aromatics.

The feedstocks of the inventive process are selected from middle distillates, such as diesel fuel, jet fuel, kerosene and gas oils. The particular feedstocks that are of the focus of the process are those middle distillate feedstocks that contain significant concentrations of organic nitrogen compounds and polynuclear aromatics that need to be removed in order to provide a final diesel product that meets the required quality standards. These feedstocks typically have a characteristically low Cetane Index due to the presence of significant concentrations of mono or polynuclear aromatics. These feedstocks also typically have significantly high concentrations of organic sulfur, which also must be removed in order to provide the final diesel product having a low enough concentration of sulfur to meet the requirements of a low-sulfur diesel product and, preferably, an ultra-low diesel product.

The middle distillates typically comprise a hydrocarbon fraction boiling in the range of from about 300° F. (149° C.) to about 700° F. (371° C.), as determined by test method ASTM D86. The kerosene boiling range is from about 300° F. (149° C.) to about 450° F. (232° C.), and the diesel boiling range is from about 450° F. (232° C.) to about 700° F. (371° C.). Gasoline normally has a boiling range of from the boiling temperature of amylenes to an endpoint of about 400° F. (204° C.). A gas oil fraction will normally have a boiling range of between about 600° F. (316° C.) to about 780° F. (416° C.). The boiling point ranges of the various product fractions will vary depending on specific market conditions, refinery locations, etc. It is common for boiling ranges to differ or overlap between refineries.

The middle distillate feedstock may include any one or more of a variety of feedstocks such as straight run diesel, jet fuel, kerosene or gas oils, vacuum gas oils, coker distillates, catalytic cracker distillates and hydrocracker distillates. The preferred middle distillate feedstock is one that may be processed by the inventive process so as to provide a final diesel product that meets saleable product specifications, but, especially, a low-sulfur or ultra low-sulfur diesel product that has a high Cetane Index.

It is preferred for the middle distillate feedstock of the process to have an initial boiling point of greater than about 350° F. (177° C.), and, it is also preferred for it to have a 10% point of at least about 370° F. (188° C.). It is preferred for the 90% point of the middle distillate feedstock to be less than about 700° F. (371° C.).

The middle distillate feedstock of the process contains a concentration of nitrogen compounds, most of which are organonitrogen compounds, in an amount in the range of from 100 ppmw to 3500 ppmw. More typically, for the distillate feedstocks that are expected to be handled by the process, the nitrogen concentration of the middle distillate feedstock is in the range of from 200 ppmw to 2500 ppmw, and, most typically, from 250 ppmw to 1000 ppmw.

When referring herein to the nitrogen content of a feedstock, product or other hydrocarbon stream, the presented concentration is the value for the nitrogen content as determined by the test method ASTM D5762-12 entitled "Standard Test Method for Nitrogen in Petroleum and Petroleum Products by Boat-Inlet Chemiluminescence." The units used in this specification, such as ppmw or wt. %, when referring to nitrogen content are the values that correspond to those as reported under ASTM D5762, i.e., in micrograms/gram (μg/g) nitrogen, but converted into referenced unit.

The total sulfur content of the middle distillate feedstock will normally be in the range of from about 0.1 wt. % to about 3.5 wt. %. More typically, however, the total sulfur content, which is generally in the form of organic sulfur compounds, is in the range of from 0.15 wt. % to 2.0 wt. %.

When referring herein to "sulfur content" or "total sulfur" or other similar reference to the amount of sulfur that is contained in a feedstock, product or other hydrocarbon stream, what is meant is the value for total sulfur as determined by the test method ASTM D2622-10, entitled "Standard Test Method for Sulfur in Petroleum Products by Wavelength Dispersive X-ray Fluorescence Spectrometry." The use of weight percent (wt. %) values of this specification when referring to sulfur content correspond to mass % values as would be reported under the ASTM D2622-10 test method.

One of the particular problems that the inventive process seeks to address is the processing of middle distillate feedstocks that have significant concentrations of polyaromatic, or polynuclear aromatic, hydrocarbons in order to provide a diesel product that has a significantly low aromatics content such that its Cetane Index is acceptably high. Not all feedstocks will contain significant concentrations of polyaromatic compounds. Polyaromatics are known to be particularly potent atmospheric pollutants and their presence in diesel fuel tend to lower its Cetane Index.

Polyaromatic compounds in general consist of fused aromatic rings and normally do not contain heteroatoms or have substituents. The simplest of the polyaromatics is naphthalene, which contains only two aromatic rings. Other simple polyaromatic compounds include, for example, anthracene (3 rings), and tetracene (4 rings). The polyaromatic compounds predominantly comprise two and three ring compounds with very little, if any, four ring compounds. The aromatic rings of the polyaromatic compounds may be arranged in any order and relative to each other by no particular geometric arrangement.

The concentration of the polyaromatics in the middle distillate feedstock of the invention typically will be at least about 12 wt. % of the feedstock. One of the features of the inventive process is that is provides for the processing of middle distillate feedstocks that have significantly high concentrations of polyaromatic compounds, and, thus, the amount of polyaromatics contained in feedstock of the process can exceed 15 wt. %, and it even can be greater than 17 wt. %. The upper end of the range for the polyaromatics concentration of the middle distillate feedstock can be less than 50 wt. % or less than 30 wt. % or even less than 15 wt. %. A typical range for the polyaromatics concentration can be from 12 wt. % to 50 wt. %, or from 15 wt. % to 30 wt. % or to 25 wt. %.

Regarding the monoaromatic compounds, e.g. benzene and benzene derivatives, such as the alkyaromatic compounds of toluene, xylene, ethylbenzene and the like, the concentration thereof in the middle distillate feedstock is at most 40 wt. %. Typically, the concentration of monoaromatic compounds in the middle distillate feedstock is greater than 1 wt. % and less than 25 wt. %, and, more typically, it is in the range of from 2 wt. % to 15 wt. %.

The method used to determine the hydrocarbon type (i.e., saturates, monoaromatics, diaromatics, and polyaromatics) and to measure the amounts of monoaromatic hydrocarbons, diaromatic hydrocarbons, triaraomtic hydrocarbons in a feedstock, product or other hydrocarbon stream is the IP391 Method, which uses high performance liquid chromatography (HPLC) with refractive index detection.

The middle distillate feedstock of the process will, generally, have a low Cetane Index that makes it unsuitable as a diesel product even if the feedstock were to otherwise meet certain of the other product specifications such as the sulfur content and nitrogen content. The Cetane Index of the middle distillate feedstock, thus, is less than about 40. More typically, however, its Cetane Index is less than 35, and, even, less than 30.

One of the beneficial aspects of the inventive process is that it provides for the processing of the middle distillate feedstock to yield a final diesel product having a suitably high Cetane Index. It is preferred for the Cetane Index of the final diesel product to be at least 40. Usually, the process can provide a diesel product having a Cetane Index in the range of from about 40 to about 50. It is most preferred for the Cetane Index to be as high as is feasible and, thus, greater than 45 or even greater than 49. A practical upper limit for the range of values for Cetane Index of the final diesel product provided by the process is less than 65 or even less than 60.

The term "Cetane Index" that is used in this specification is a calculated number based on the density of the diesel fuel and its distillation range as determined by test method ASTM D86. The term "Cetane Index," therefore, as it is used herein, means the calculated number as it is determined by the test method ASTM D4737, entitled "Calculated Cetane Index by Four Variable Equation." This four point method is based on the density of the diesel fuel and the 10%, 50%, and 90% recovery temperatures of a distillation of the diesel fuel as determined by the test method ASTM D86.

The process of the invention includes two reaction zones. The first reaction zone, which is defined by a first reactor vessel, or several reactor vessels, is operated under suitable hydrodenitrogenation and polyaromatics saturation conditions so as to provide for the hydrodenitrogenation of the organic nitrogen and for the saturation of the polyaromatics that are contained in the middle distillate feedstock to at least monoaromatic compounds.

A treated effluent is yielded from the first reaction zone. The treated effluent has an organic nitrogen concentration and a polyaromatics concentration that are reduced below such concentrations of the distillate feedstock charged to the first reaction zone. The treated effluent passes from the first reaction zone and is introduced into a high pressure interstage stripper.

The second reaction zone, defined by a second reactor vessel, is operated under suitable monoaromatics saturation conditions so as to provide for the saturation removal of at least a portion of the monoaromatics that are contained in a stripped liquid fraction yielded from the high pressure interstage stripper and charged to the second reaction zone.

The stripped liquid fraction is supplied from the high pressure interstage stripper that is interposed between the first reaction zone and the second reaction zone. The high pressure interstage stripper defines a lower section, which includes a stripping zone, and an upper section, which includes a phase separation zone. The treated effluent from the first reaction zone is introduced into the upper section of the high pressure interstage stripper wherein a gaseous fraction is separated and formed. The gaseous fraction passes from the phase separation zone of the high pressure interstage stripper to a recycle compressor, and the stripped liquid fraction passes from the stripping zone of the high pressure interstage stripper as a feed to the second reaction zone.

A reactor product, which comprises a distillate portion, is yielded from the second reaction zone. This reaction product has a monoaromatics concentration that is reduced relative to the monoaromatics concentration of the stripped liquid fraction charged to the second reaction zone due to the saturation of at least a portion of the monoaromatics contained in the stripped liquid fraction. This reduction in the concentration amount of aromatics in the stripped liquid fraction correlates with an improvement or enhancement in the Cetane Index of the distillate portion of the stripped liquid fraction over the Cetane Index of the distillate feedstock to the process.

Hydrogen is usually required to be added to the process due to the hydrodenitrogenation, hydrodesulfurization and aromatics saturation that are provided by the process. Thus, make-up hydrogen is introduced into the process. The introduction of the make-up hydrogen into the process may be at any one of a number of suitable locations. Make-up hydrogen can be introduced with the distillate feedstock, or it can be introduced into the suction side of a hydrogen recycle compressor (later described), or it can be introduced into the stripped liquid fraction, or it can be introduced at any number of other suitable locations within the process. In one desirable embodiment of the inventive process, a make-up hydrogen feed, which comprises hydrogen, is introduced into the stripped liquid fraction prior to introducing the resulting mixture, comprising the make-up hydrogen and the stripped liquid fraction, into the second reaction zone.

The hydrogen and lighter hydrocarbons need to be separated from reactor product of the second reaction zone in order to provide a final diesel product that meets the required product specifications. The reactor product then passes from the second reaction zone to a second separator. The second separator defines a second separation zone, which receives the reactor product and provides for the separation thereof into a first hydrogen portion and a dearomatized distillate portion. The first hydrogen portion comprises hydrogen, and, may also include light, normally gaseous, under the conditions of the second separation zone, hydrocarbons.

The dearomatized distillate portion is passed to a product stripper. The product stripper defines a stripping zone and provides for removing lighter hydrocarbons, hydrogen sulfide and ammonia from the dearomatized distillate portion. Yielded from the product stripper is a diesel product and an overhead product, which comprises lighter hydrocarbons, hydrogen sulfide and ammonia. Thus, yielded as a bottoms product from the product stripper is a diesel product that has a characteristically high Cetane Index. The diesel product also has significantly reduced polyaromatics and monoaromatics concentration levels as compared to the distillate feedstock to the process. Also, the diesel product has a significantly reduce concentrations of nitrogen and total sulfur. The yielded diesel product, thus, is of a very high quality as being able to meet specifications for a low-sulfur diesel product having a high Cetane Index.

The diesel product provided by the process is a low-sulfur diesel having a total sulfur concentration that is, typically, less than 50 ppmw, but it is more desirable for the sulfur concentration of the diesel product to less than 25 ppmw. Preferably, the diesel product sulfur concentration is less than 15 ppmw, and, most preferably, it is less than 10 ppmw.

The Cetane Index of the diesel product is typically at least or greater than 40, but, preferably, it is at least or greater than 42. Especially preferred is for the Cetane Index of the diesel product to be at least or greater than 45. The diesel product from the process may be blended with other diesel components that have lower values, or higher values, for their Cetane Index in order to provide a blended product that meets certain specified Cetane Index requirements.

As discussed elsewhere herein, a particularly beneficial feature of the inventive process is that it provides for a final diesel product having a low total nitrogen concentration. Typically, the process provides a diesel product having a concentration of organic nitrogen that is less than 100 ppmw. It is preferred, however, for the nitrogen concentration to be less than 50 ppmw, and, more preferred, for the nitrogen concentration to be less than 30 ppmw. An especially preferred nitrogen concentration is less than 25 ppmw. The lower limit for the nitrogen concentration is typically not measurable.

Another of the particularly beneficial features of the inventive process is that it provides for the removal of the polyaromatics and monoaromatics from the middle distillate feedstock to provide the diesel product having a substantially reduced aromatics content over that of the middle distillate feedstock to the process. This is predominantly done by the hydrogen saturation in the first reaction zone and the second reaction zone of the process. The total aromatics content of the diesel product of the process, thus, is less than 40 wt. %.

The concentration of polyaromatics in the diesel product is less than 11 wt. % with the remainder being monoaromatics. It is preferred for the concentration of polyaromatics in the diesel product to be less than 8 wt. %, more preferred, the concentration of polyaromatics is less than 5 wt. %, and, most preferred, less than 2 wt. %.

The amount of monoaromatics contained in the diesel product typically can be in the range of from about 0.5 wt. % to about 30 wt. %. More typically, the concentration of monoaromatics is in the range of 5 wt. % to 25 wt. %. Most typically, the concentration is from 10 wt. % to 20 wt. %.

The gaseous fraction from the high pressure interstage stripper passes to the recycle compressor that provides for compressing the gaseous fraction and introducing the compressed gaseous fraction with the distillate feedstock into the first reaction zone.

In an embodiment of the process, the gaseous fraction may be treated to remove therefrom hydrogen sulfide and ammonia before the resulting treated gaseous fraction is recycled by way of a recycle compressor, as a feed to the first reactor vessel. In this feature of the process, the gaseous fraction is introduced into a contactor vessel. The contactor vessel defines a contacting zone and provides for contacting the gaseous fraction with an absorption solvent, which functions to remove hydrogen sulfide and ammonia from the gaseous fraction. The absorption solvent is countercurrently and stagewise contacted with the gaseous fraction under suitable absorption contacting conditions. The absorption solvent can be any suitable solvent known to those skilled in the art for use as aforementioned. There are many known amine compounds that are in use for such applications.

The treated gaseous fraction then passes from the contacting zone to the suction side of the recycle compressor. The recycle compressor provides for compressing and recycling of the treated gaseous fraction to the first reaction zone. The resulting compressed and treated gaseous fraction then passes from the discharge side of the recycle compressor and is introduced as a feed into the first reaction zone of the process along with the introduction of the middle distillate feedstock.

One unique and necessary feature of the inventive process is that the first hydrogen portion from the second separator is recycled and introduced as a stripping gas into the lower section stripping zone of the high pressure interstage stripper. The first hydrogen portion, thus, passes from the second separation zone of the second separator either directly to the high pressure interstage stripper without prior treatment or it may be treated prior to its introduction into the high pressure interstage stripper.

In the inventive process, both the first reaction zone and the second reaction zone may be operated under high pressure reaction conditions or the process may use the two reaction zones in a manner such that the first reaction zone is operated under low-pressure conditions and the second reaction zone is operated under high-pressure conditions. The low-pressure reaction conditions, however, typically will not provide for the desired significant aromatics saturation or organic nitrogen removal. So, it is preferred to operate the first reaction zone under higher pressure conditions.

The second reaction zone may be operated at only a slightly higher reaction pressure than does the first reaction zone. In this operating mode, the second reaction zone reaction pressure is in the range of from 10 to 100 psig greater than the first reaction zone pressure. Preferably, the second reaction zone reaction pressure is in the range of from 20 to 80 psig greater than the first reaction zone pressure, and, most preferably, it is from 25 to 75 psig.

The first reactor is operated as a trickle-flow reactor in that the middle distillate feed that is charged to the first reaction zone is generally in liquid form, admixed with either make-up hydrogen or recycle hydrogen or a combination of both, and charged to the first reaction zone in a downflow direction.

The reaction conditions within the first reaction zone are preferably such as to be effective to provide for significant hydrodenitrogenation of the organic nitrogen compounds of the middle distillate feedstock and for significant hydrogen saturation of polyaromatics in order to yield a treated effluent from the first reaction zone that has a reduced organic nitrogen concentration relative to the organic nitrogen concentration of the middle distillate feedstock and a reduced polyaromatics concentration relative to the polyaromatics concentration of the middle distillate feedstock.

The first reaction zone will, thus, be operated at a first reaction zone temperature in the range of from 400° F. to 800° F., preferably, from 450° F. to 750° F., and, most preferably, from 500° F. to 700° F.

The pressure at which the first reaction zone can, also, be an important, if not an essential, contributor, in addition to the particular type of catalyst that is used in the first reaction zone, to providing for the hydrogen saturation of the organic nitrogen and polyaromatic compounds of the middle distillate feedstock of the process.

The first reaction zone pressure of the process will typically be in the range of from 1000 to 2000 psig, but, preferably, it is in the range of from 800 to 1500 psig. More preferably, the first reaction zone pressure is in the range of from 900 psig to 1200 psig.

The liquid hourly space velocity (LHSV) at which the first reaction zone is operated is typically in the range of from 0.1 $hr^{-1}$ to 10 $hr^{-1}$. Preferably, the LHSV is in the range of from 0.5 $hr^{-1}$ to 3 $hr^{-1}$.

The catalyst that is used in the first reaction zone, referred to herein as the first catalyst, should be any catalyst composition that suitably provides for the hydrodenitrogenation and polyaromatics saturation required of the process.

Generally, the first catalyst is a base metal catalyst in that it comprises a Group VIII metal that is either cobalt of nickel, or a combination of both, or a Group VI metal that is either molybdenum or tungsten, or a combination of both, or a combination of either the Group VIII metal and the Group VI metal, supported on a high surface area material that is preferably an inorganic oxide such as silica, alumina, silica-alumina, or a combination thereof.

The Group VIII metal is typically present in the base metal catalyst in an amount in the range of from about 2 to about 20 weight percent, preferably from about 4 to 12 about weight percent.

The Group VI metal is typically present in the base metal catalyst in an amount in the range of from about 1 to about 25 weight percent, preferably from about 2 to 25 weight percent.

Particularly preferred catalyst compositions for use as the first catalyst are those that are disclosed or claimed in U.S. Pat. No. 8,262,905, issued Sep. 11, 2012, which patent is incorporated herein by reference. This catalyst is preferred because of its beneficial properties over other base metal catalyst compositions and because of how it helps to provide for the hydrodenitrogenation and polyaromatics saturation that are required of the first reaction step of the inventive process. This catalyst, in general, comprises a support material that is loaded with a base metal component, which is or can be converted to a metal compound having hydrogenation activity, and is impregnated with a polar additive with or without an accompanying hydrocarbon oil. The catalyst also may be a derivative of the aforedescribed catalyst, such as the impregnated catalyst that has undergone a hydrogen and sulfur treatment. Suitable and exemplary catalysts are described in detail in the aforementioned U.S. Pat. No. 8,262,905. The metal loadings are within the ranges described above.

Another preferred catalyst composition for use as the first catalyst of the first reaction zone include those that are disclosed or claimed in U.S. Pat. No. 6,218,333, issued Apr. 17, 2001, or U.S. Pat. No. 6,281,158, issued Aug. 28, 2001, or U.S. Pat. No. 6,290,841, issued Sep. 18, 2001. These patents are incorporated herein by reference. This catalyst provides for many of the same benefits as does the catalyst of U.S. Pat. No. 8,262,905. This catalyst, in general, comprises a composition that is prepared by combining a porous support with a base metal and reducing the volatiles content of the combination mixture to form a precursor that is not calcined before sulfurizing the combination mixture after the volatiles reduction. The metal loadings are within the ranges described above.

In one particular embodiment of the inventive process, the first reaction zone that is defined by the first reactor includes at least two distinct or two or more catalyst beds. Within each catalyst bed is a bed of catalyst particles of a first catalyst that are supported upon a support internal that spans the cross-sectional area of the first reactor and provides support for each of the beds of catalyst particles having a bed depth. The multiple catalyst beds contained in the first reaction zone are placed in a spaced relationship to each other so as to form a void volume space between each bed within the first reaction zone. The formation of the void volume spaces between the catalyst beds allows for the introduction of quench gas into each of the volume spaces and for better control of the temperature conditions within the first reaction zone. This control of the temperature conditions also allows for better control of the reaction conditions within the first reaction zone so as to control the conditions for the polyaromatics saturation and organic nitrogen hydrogenation.

In another aspect of the inventive process, the second reaction zone, in addition to operating under high reactor pressure conditions, utilizes a catalyst that is not a noble metal catalyst as is used in many of the prior art processes. Instead, the catalyst used in the second reaction zone is a base metal catalyst. Therefore, the second catalyst contained within the second reaction zone that is to be used in the second reaction zone comprises a Group VIII metal that is either cobalt of nickel, or a combination of both, or a Group VI metal that is either molybdenum or tungsten, or a combination of both, or a combination of either the Group VIII metal and the Group VI metal, supported on a high surface area material that is preferably an inorganic oxide such as silica, alumina, silica-alumina, or a combination thereof. The metal loadings are within the same ranges as described above for the first catalyst.

It is also noted that preferred catalyst compositions for use as the second catalyst of the process include the catalyst compositions disclosed or claimed in U.S. Pat. No. 8,262,905, or U.S. Pat. No. 6,218,333, or U.S. Pat. No. 6,281,158, or U.S. Pat. No. 6,290,841, and as described above for the first catalyst.

The second reaction zone of the process is operated so as to provide for the saturation of the monoaromatic compounds that are contained in the stripped liquid fraction from the high pressure interstage stripper. The stripped liquid fraction is, therefore, contacted with the second catalyst of the second reaction zone which is operated under suitable conditions for the saturation of the monoaromatics of the stripped liquid fraction and to yield the second reaction zone reactor product.

The pressure and temperature at which the second reaction zone is operated are such as to provide for the hydrogen saturation monaromatic compounds of the stripped liquid fraction of the process. A high second reaction zone operating pressure is a necessary operating condition of the inventive process. The second reaction zone pressure of the process will typically be in the range of from 1000 to 2000 psig, but, preferably, it is in the range of from 1000 to 1500 psig. More preferably, the second reaction zone pressure is in the range of from 1050 psig to 1200 psig.

The operating pressure of the second reaction zone, however, as discussed above, is in the range of from 10 to 60 psig greater than the first reaction zone pressure, or from 15 to 50 psig greater than the first reaction zone pressure, or from 25 to 40 psig greater than the first reaction zone pressure.

The second reaction zone is operated at a second reaction zone temperature in the range of from 400° F. to 800° F., preferably, from 450° F. to 750° F., and, most preferably, from 500° F. to 700° F. The liquid hourly space velocity (LHSV) at which the second reaction zone is operated typically in the range of from 0.1 $hr^{-1}$ to 100 $hr^{-1}$. Preferably, the LHSV is in the range of from 0.5 $hr^{-1}$ to 10 $hr^{-1}$.

Presented in the FIGURE is a representative flow scheme of an embodiment of the inventive process 10. Process 10 provides for improving the properties of a distillate feedstock having significant concentrations of nitrogen and polyaromatic compounds.

A middle distillate feedstock passes by way of conduit 12 to first reaction stage 14. First reaction stage 14 includes a first reaction zone that is defined by one or more reactors. Depicted in the FIGURE are two reactor vessels 16 and 18. Reactor vessels 16 and 18, in combination, define the first reaction zone, which comprises first reaction zone **16*a*, defined by reactor vessel 16, and first reaction zone 18*a*, defined by reactor vessel 18. Before the middle distillate feedstock is introduced into first reaction zone 16*a*, it is combined with a recycle hydrogen stream that passes to first reaction stage 14 by way of conduit 19**.

First reactor 16 defines first reaction zone **16*a*, which includes one or more distinct catalyst beds 20. Within each of the catalyst beds 20 is a bed of catalyst particles supported upon a support internal 22 that spans the cross-sectional area of the first reactor 16 and provides support for each of the beds of catalyst particles having a bed depth. The catalyst particles of the catalyst beds 20** include a first catalyst as described herein.

First reactor 18 defines first reaction zone **18*a*, which includes one or more distinct catalyst beds 24. Within each of the catalyst beds 24 is a bed of catalyst particles supported upon a support internal 26 that spans the cross-sectional area of the first reactor 18 and provides support for each of the beds of catalyst particles having a bed depth. The catalyst particles of the catalyst beds 24** include a first catalyst as described herein.

The combined distillate feedstock and recycle hydrogen passes by way of conduit 30 and is introduced into first reaction zone **16*a*, wherein it is contacted with the first catalyst contained in the catalyst beds 20 of the first reaction zone 16*a*. Effluent from first reaction zone 16*a* passes by way of conduit 32 and is introduced into first reaction zone 18*a*, wherein it is contacted with the first catalyst contained in the catalyst beds 24 of the first reaction zone 18*a*. The first reaction zones of 16*a* and 18*a*** are operated under hydrodenitrogenation and polyaromatics saturation conditions as described elsewhere herein.

A treated effluent is yielded and passes from the first reaction zone **18*a* by way of conduit 34 to be introduced into high pressure interstage stripper 38. The treated effluent has a significantly reduced organic nitrogen and polyaromatics concentrations relative to such concentrations of the middle distillate feedstock. High pressure interstage stripper 38 defines a lower section 40, which includes a stripping zone 42, and an upper section 44, which includes a phase separation zone 46**.

High pressure interstage stripper 38 provides for stripping a gaseous fraction from the treated effluent and to provide a stripped liquid fraction. The treated effluent passes from first reaction zone 18*a* through conduit 34 and is introduced into the upper section 44 of the high pressure interstage stripper 38, wherein the gaseous fraction is separated and formed.

The gaseous fraction passes from the phase separation zone 46 of the high pressure interstage stripper 38 through conduit 52 to recycle compressor 54. Recycle compressor 54 defines a compression zone 88 and provides for the compression and recycling of the gaseous fraction to first reactor zone 16*a*. The compressed gaseous fraction passes from recycle compressor 54 through conduit 19 to be mixed with the middle distillate feedstock passing through conduit 12. The mixture of middle distillate feedstock and compressed gaseous fraction then passes through conduit 30 to be introduced to first reaction stage 14 of process 10.

The high pressure interstage stripper 38 operates as a hot, high-pressure stripper-separator in that the treated effluent from first reaction zone 18*a* that is introduced into the upper section 44 of the high pressure interstage stripper 38 is not significantly cooled before its introduction, and the operating pressure of the high pressure interstage stripper 38 is maintained only slightly below the operating pressure of first reaction zone 18*a*. The pressure differential between high pressure interstage stripper 38 and first reaction zone 18*a* is such as to provide a driving force for the flow of the treated effluent into high pressure interstage stripper 38 and to allow for its effective control.

A stripped liquid fraction passes from lower section 40 of the high pressure interstage stripper 38 through conduit 58 to second reactor 60. Second reactor 60 defines a second reaction zone 64 that includes or contains at least one bed of second catalyst. The second catalyst is described in detail elsewhere herein. The second reaction zone 64 is operated under monoaromatics saturation conditions as described elsewhere herein.

Make-up hydrogen passing by way of conduit 68 is combined with the stripped liquid fraction before the resulting mixture of make-up hydrogen and stripped liquid fraction is introduced into the second reaction zone 64 via conduit 58. The stripped liquid fraction is contacted with the second catalyst contained within second reaction zone 64.

A reactor product is yielded and passes from second reaction zone 64 through conduit 70 to second separator 72. The reactor product comprises a distillate portion having a value for its Cetane Index that is much enhanced over the Cetane Index of the middle distillate feedstock charged to the process 10.

The reactor product is introduced into the second separator 72, which defines a second separation zone 74 that receives the reactor product and provides for the separation of the reactor product into a first hydrogen portion and a dearomatized distillate portion. The first hydrogen portion comprises hydrogen, and, may also include light, normally gaseous, under the conditions of the second separation zone, hydrocarbons. The first hydrogen portion passes from the second separator zone 74 of second separator 72 through conduit 90 to be recycled and introduced as a stripping gas into the stripping zone 42 of the lower section 40 of the high pressure interstage stripper 38.

The first hydrogen portion passes from the second separation zone 74 of the second separator 72 either directly to the high pressure interstage stripper 38, without prior treatment, or it may be treated prior to its introduction into the high pressure interstage stripper 38. Thus, an optional treating unit 92 may be interposed into conduit 90. Treating unit 92 provides means for treating the first hydrogen portion to remove contaminating compounds, for example, hydrogen sulfide or ammonia, or both such compounds. An amine treatment unit is one example of a treatment unit that may suitably be used as treating unit 92.

The dearomatized distillate portion passes from second separation zone 74 by way of conduit 76 and is introduced into stripping zone 80 that is defined by product stripper 82. The product stripper 82 provides means for stripping or removing lighter hydrocarbons from the dearomatized distillate portion charged to the product stripper 82, and it provides for yielding a diesel product. The yielded diesel product, having the properties as specified herein, passes from stripping zone 80 through conduit 84, and the lighter hydrocarbons that are stripped from the dearomatized distillate portion pass from stripping zone 80 by way of conduit 86.

It will be apparent to one of ordinary skill in the art that many changes and modifications may be made to the invention without departing from its spirit and scope as set forth herein.

The invention claimed is:

1. A process for improving the properties of a distillate feedstock having a nitrogen concentration, a polyaromatics concentration of at least about 12 wt. % of said distillate feedstock, and a Cetane Index, wherein said process comprises:

contacting said distillate feedstock with a first catalyst contained within a first reaction zone for the hydrodenitrogenation of organic nitrogen compounds and for the saturation of polyaromatic compounds, wherein said first reaction zone is operated under suitable hydrodenitrogenation and polyaromatics saturation conditions, and yielding from said first reaction zone a treated effluent comprising distillate boiling range hydrocarbons having a reduced nitrogen concentration relative to said nitrogen concentration and a reduced polyaromatics concentration relative to said polyaromatics concentration;

passing said treated effluent comprising distillate boiling range hydrocarbons to a high pressure interstage stripper, comprising a stripper vessel which defines a lower section, including a stripping zone, and an upper section, including a phase separation zone, and introducing said treated effluent into said upper section of said stripper vessel and yielding from said lower section a stripped liquid fraction and yielding from said upper section a gaseous fraction;

contacting said stripped liquid fraction with a second catalyst contained within a second reaction zone for the saturation of monoaromatics, wherein said second reaction zone is operated under suitable monoaromatics saturation conditions, and yielding from said second reaction zone a reactor product, wherein said second catalyst comprises a base metal catalyst comprising either a nickel component or cobalt component and either a molybdenum component or a tungsten component supported on an inorganic oxide support, and wherein said reactor product comprises a distillate portion having an enhanced Cetane Index relative to said Cetane Index of said distillate feedstock;

passing said reactor product to a second separator for separating said reactor product into a hydrogen portion and a dearomatized distillate portion; and introducing said first hydrogen portion into said lower section of said stripper vessel.

2. A process as recited in claim 1, further comprising:

passing a portion of said gaseous fraction to a recycle compressor that provides for compressing said gaseous fraction and introducing the resulting compressed gaseous fraction with said distillate feedstock to said first reaction zone.

3. A process as recited in claim 2, further comprising:

introducing make-up hydrogen into said stripped liquid fraction prior to introducing a resulting mixture, comprising said make-up hydrogen and said stripped liquid fraction into said second reaction zone.

4. A process as recited in claim 3, further comprising:

passing said dearomatized distillate portion to a product stripper for removing lighter hydrocarbons from said dearomatized distillate portion and providing a diesel product having a high cetane index.

* * * * *